US009844785B2

(12) United States Patent
Bauditsch et al.

(10) Patent No.: US 9,844,785 B2
(45) Date of Patent: Dec. 19, 2017

(54) OIL CENTRIFUGE HAVING A THROTTLE POINT AND SAFETY VALVE

(71) Applicant: MANN+HUMMEL GMBH, Ludwigsburg (DE)

(72) Inventors: Peter Bauditsch, Brackenheim (DE); Martin Weindorf, Kornwestheim (DE); Helmuth Haubenreich, Ludwigsburg (DE); Thomas Storch, Murr (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 478 days.

(21) Appl. No.: 14/448,052

(22) Filed: Jul. 31, 2014

(65) Prior Publication Data

US 2015/0038310 A1 Feb. 5, 2015

(30) Foreign Application Priority Data

Jul. 31, 2013 (DE) ..... 10 2013 012 673

(51) Int. Cl.

| | |
|---|---|
| ***B04B 9/06*** | (2006.01) |
| ***B04B 11/04*** | (2006.01) |
| ***B04B 9/10*** | (2006.01) |
| ***B04B 5/00*** | (2006.01) |

(52) U.S. Cl.

CPC ..... *B04B 11/04* (2013.01); *B04B 5/005* (2013.01); *B04B 9/06* (2013.01); *B04B 9/10* (2013.01)

(58) Field of Classification Search

CPC B04B 11/04; B04B 9/10; B04B 5/005; B04B 9/06

USPC ..... 494/24, 36, 43, 49, 56, 64, 65, 67, 83, 494/84, 901, 60, 74, 79; 210/168, 171, 210/232, 360.1, 380.1, 416.5; 184/6.24

See application file for complete search history.

(56) References Cited

U.S. PATENT DOCUMENTS

| | | | | |
|---|---|---|---|---|
| 5,904,841 | A * | 5/1999 | Penny | B04B 11/04 123/196 A |
| 6,454,694 | B1 * | 9/2002 | Herman | B04B 1/08 494/49 |
| 6,974,408 | B2 * | 12/2005 | Grosse-Wiesmann | B04B 5/005 494/49 |
| 7,377,893 | B2 * | 5/2008 | Herman | B04B 1/08 494/49 |
| 7,393,317 | B2 * | 7/2008 | Herman | B04B 5/005 494/49 |
| 7,871,364 | B2 * | 1/2011 | Herman | B04B 5/005 494/49 |
| 8,323,168 | B2 * | 12/2012 | Naegelen | B04B 11/04 494/49 |

(Continued)

FOREIGN PATENT DOCUMENTS

| | | | | |
|---|---|---|---|---|
| DE | EP 1217183 | A1 * | 6/2002 | B04B 5/005 |
| DE | 10341054 | A1 * | 3/2004 | B04B 5/005 |

(Continued)

*Primary Examiner* — Charles Cooley
(74) *Attorney, Agent, or Firm* — James Hasselbeck

(57) ABSTRACT

An oil centrifuge has an integral, rotatably mounted centrifuge rotor and a feed tube connected to the centrifuge rotor. A flow path is provided that supplies oil to the centrifuge rotor. The feed tube is a section of the flow path. The flow path has a throttle point having a reduced throttle cross section that is reduced relative to an upstream flow path cross section of the flow path upstream of the throttle point.

9 Claims, 3 Drawing Sheets

(56) References Cited

U.S. PATENT DOCUMENTS

| | | | | |
|---|---|---|---|---|
| 2002/0088445 | A1* | 7/2002 | Weindorf | B04B 5/005 123/572 |
| 2005/0020428 | A1* | 1/2005 | Grosse-Wiesmann | B04B 5/005 494/49 |
| 2006/0229185 | A1* | 10/2006 | Herman | B04B 5/005 494/49 |
| 2006/0240965 | A1* | 10/2006 | Herman | B04B 5/005 494/49 |
| 2008/0220957 | A1* | 9/2008 | Herman | B04B 5/005 494/5 |
| 2011/0263406 | A1* | 10/2011 | Naegelen | B04B 11/04 494/5 |
| 2015/0038310 | A1* | 2/2015 | Bauditsch | B04B 9/10 494/5 |

FOREIGN PATENT DOCUMENTS

| | | | | | |
|---|---|---|---|---|---|
| DE | 202004017820 | U1 | | 3/2006 | |
| DE | 102006021033 | | * | 11/2007 | B04B 5/005 |
| DE | EP 2832448 | A1 | * | 2/2015 | B04B 9/10 |
| DE | WO 2015014537 | A1 | * | 2/2015 | B04B 5/005 |
| GB | 246537 | A1 | | 1/1926 | |
| GB | 2406893 | A | | 4/2005 | |

* cited by examiner

OIL CENTRIFUGE HAVING A THROTTLE POINT AND SAFETY VALVE

CROSS-REFERENCE TO RELATED APPLICATION

This application claims the benefit of German patent application No. 10 2013 012 673.8, filed Jul. 31, 2013, the entire contents of the aforesaid German patent application being incorporated herein by reference.

BACKGROUND OF THE INVENTION

The invention relates to an oil centrifuge comprising an integral, rotatably mounted centrifuge rotor and a feed tube connected to the centrifuge rotor which defines at least one section of the flow path of the oil to the centrifuge rotor. The oil centrifuge can be used as an industrial oil centrifuge but also in a motor vehicle. The oil centrifuge can be part of an oil module which, apart from the oil centrifuge, can have an oil filter with a filter element and a heat exchanger. Oil modules of this kind are used particularly in commercial vehicles.

An oil filter with a centrifuge rotor is disclosed in DE 103 29 199 A1. The oil filter has a main flow filter and an auxiliary flow filter, through which the oil to be cleaned flows in succession. The main flow filter comprises a ring filter insert disposed in a housing bowl; the auxiliary flow filter comprises the centrifuge rotor into which the oil is fed from the filtered side of the main flow filter via a fixed rigid tube to the centrifuge rotor. A safety valve, which is transferred to the blocking position if the centrifuge rotor is not arranged in its correct position, is located in the transition from the tube to the centrifuge rotor.

SUMMARY OF THE INVENTION

The invention has the object to configure an oil centrifuge with centrifuge rotor such that a long operating period can be achieved with simple constructive measures.

According to the invention, this object is solved for an oil centrifuge and the centrifuge rotor in that the flow path has a throttle point with reduced throttle cross section, wherein the flow path cross section is increased at least upstream of the throttle point. The dependent claims specify expedient embodiments.

The oil centrifuge according to the invention is used, for example, for oil cleaning in internal combustion engines and has a rotatably mounted centrifuge rotor, with the help of which dirt particles contained in the oil can be removed. The oil centrifuge is preferably integrated in an oil circuit which advantageously has an oil filter with a filter element, for example, in the form of a ring filter, as the main flow filter for coarse separation, and has, downstream of the main flow filter, the oil centrifuge with the centrifuge rotor which forms the auxiliary flow filter for fine separation. Here, preferably, only some of the oil filtered by the oil filter, for example 10-20%, is fed to the oil centrifuge. In other words, the oil centrifuge is arranged in a bypass for the main flow of the oil coming from the oil filter. The oil enters the centrifuge rotor via a feed tube which forms at least one section of the flow path for the oil in the oil centrifuge. The flow path within the oil centrifuge and before the centrifuge rotor has a throttle point with reduced throttle cross section, wherein the flow path cross section upstream of the throttle point is increased relative to the throttle cross-section. In an advantageous embodiment, the flow path cross section downstream of the throttle point is also increased. The feed tube comprises the throttle point, particularly when the whole flow path is formed by the feed tube. The comments made here in conjunction with the oil centrifuge according to the invention apply correspondingly to the centrifuge rotor according to the invention.

The throttle point constitutes a bottleneck which affects a pressure loss in the oil flow. The throttle point damps pressure peaks and, as a result, equalizes the oil pressure in the centrifuge rotor, which is therefore relieved of pressure peaks, which leads to a reduction in the loading of the centrifuge rotor and to an increase in the rotor life. As the cross section downstream of the throttle point slowly increases, the remaining pressure loss can be kept relatively low so that, on the one hand, a sufficiently high pressure is available in the centrifuge rotor in order to contribute to a high rotation speed and therefore to assist the particle separation, and, on the other, the pressure variations are reduced at the throttle point so that the peak load is likewise correspondingly further reduced. The throttle point is preferably designed in such a way that the flow cross section of the flow path tapers gradually and no sudden steps in cross section occur.

As an example, the throttle point is designed as a Laval nozzle. Here, the flow cross section reduces gradually to a bottleneck and increases again gradually downstream of the bottleneck, wherein the flow cross section is always circular. Advantageously, the flow path upstream and downstream of the throttle point has the same cross section, so that the cross section of the flow path is only reduced in the region of the throttle point, and the full feed tube cross section is retained elsewhere. In the region of the throttle point, it can be expedient for the throttle point to have a diameter of a maximum of 90%, in particular a maximum of 70%, preferably a maximum of 50%, of the largest diameter of the feed tube. This diameter reduction in the region of the throttle point ensures adequate damping of pressure peaks.

According to an alternative embodiment however, it is possible for different cross sections to prevail upstream and downstream of the throttle point. For example, the cross section downstream of the throttle point is less than upstream, that is to say the input side of the throttle point.

Advantageously, the throttle point is located in the inflow region of the oil centrifuge or of the feed tube, wherein optionally also designs where the throttle point is arranged at a distance from the end faces or in the downstream region of the feed tube can be considered. In each case however, the throttle point is located upstream before discharge openings in the feed tube into the centrifuge rotor.

The feed tube can be connected to the centrifuge rotor in a fixed rotational relationship, for example when the feed tube and centrifuge rotor are designed in one piece (monolithic). In this case, the feed tube rotates with the centrifuge rotor, wherein, if necessary, the feed tube can also be designed separately, but connected to the centrifuge rotor. In an alternative embodiment with the feed tube designed separately from the centrifuge rotor, the feed tube is arranged in a fixed relationship to the housing and therefore does not rotate with the centrifuge rotor. When the feed tube is arranged in a fixed relationship to the housing and also when it is arranged rotatably on the centrifuge rotor side, it lies in the longitudinal axis of the centrifuge rotor.

It can be expedient to provide a valve in the feed tube or upstream of the feed tube. Advantageously, the valve is arranged upstream of the throttle point. However, the throttle point can also be arranged at a different point relative to the valve, for example in the valve housing, preferably in the inlet region of the valve. The valve has a safety function in order to prevent an unwanted transgression of oil in the region of the centrifuge rotor. For example, the valve is designed as a safety valve, which is only in the open position to allow the oil to flow through the feed tube when the centrifuge rotor is fitted correctly. Here, a valve body of the safety valve is held in the open position by the centrifuge rotor. If, on the other hand, the centrifuge rotor is missing or is incorrectly fitted, then the valve body is moved by the oil pressure out of the open position into a closed position in which the oil flow is interrupted.

According to a further expedient embodiment, a valve device, which comprises a pressure valve and a safety valve connected downstream of the pressure valve, is located in the feed path to the centrifuge rotor, wherein the pressure valve is only moved to the open position when a limit pressure of, for example, 2 bar is exceeded. The downstream safety valve is held in the open position by the centrifuge rotor as described above. The pressure valve and the safety valve can form one constructional unit, the two valves being connected to one another even though they can be designed separately. The valve body of the safety valve is acted upon in the open position by an actuating pin, for example, which is formed in one piece (monolithic) with the centrifuge rotor. The safety valve is designed as a ball valve, for example; correspondingly, the valve member is formed by a ball. With this embodiment, the throttle point can be arranged upstream of the valve device in a possibly existing inlet section for the oil, or downstream of the valve device in the feed tube. However, it is likewise possible to form the throttle point between the two valves, in the housing of the pressure valve or in the housing of the safety valve.

BRIEF DESCRIPTION OF THE DRAWINGS

Further advantages and expedient embodiments can be taken from the claims, the description, and the drawings.

Identical components in the figures are given the same reference numbers.

DESCRIPTION OF PREFERRED EMBODIMENTS

Figure 1:
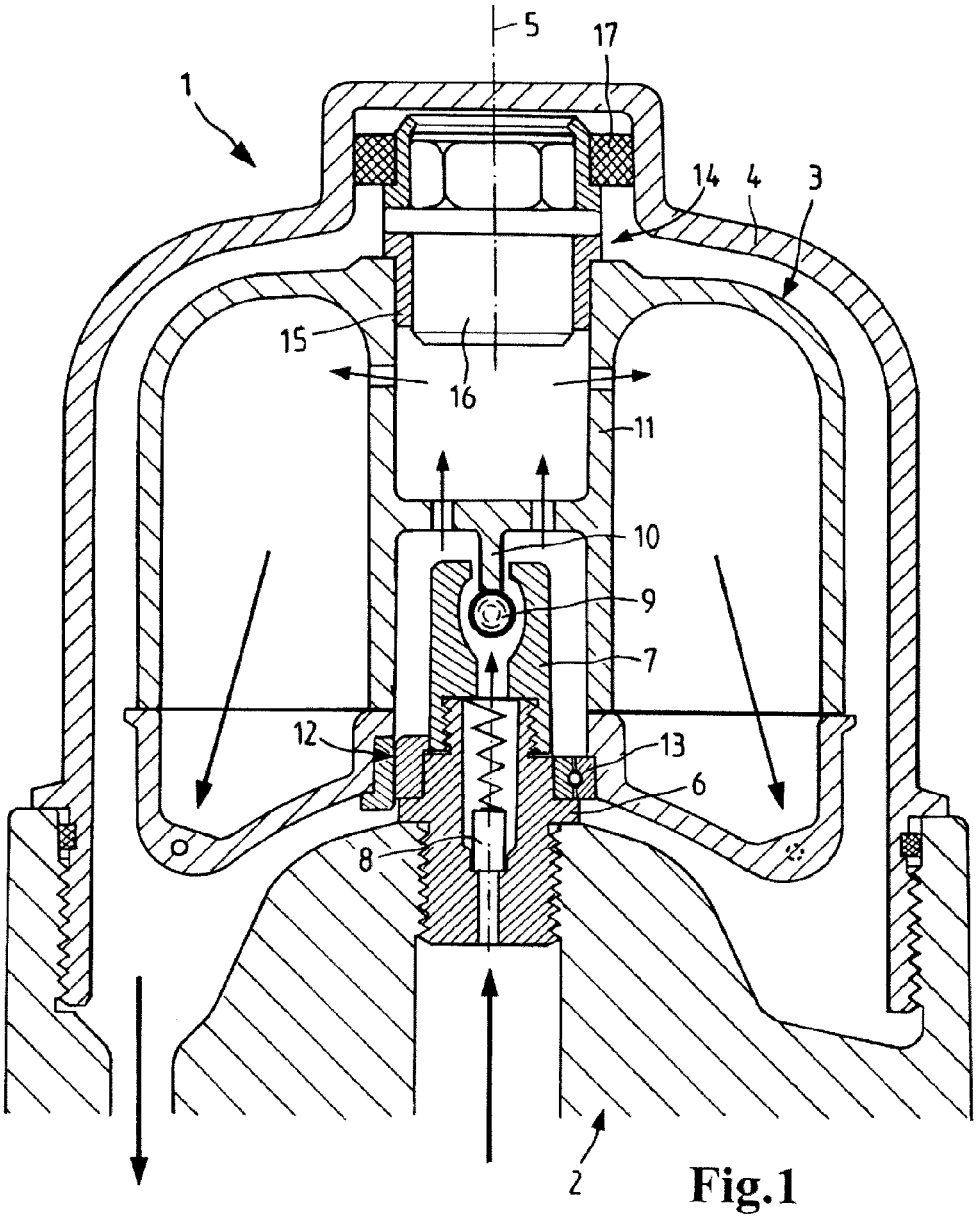
FIG. 1 shows a section through an oil centrifuge with integral centrifuge rotor having two valves arranged in tandem and a first bearing point in the region of one valve and a second bearing point on the end face of the centrifuge rotor.
Figure 2:
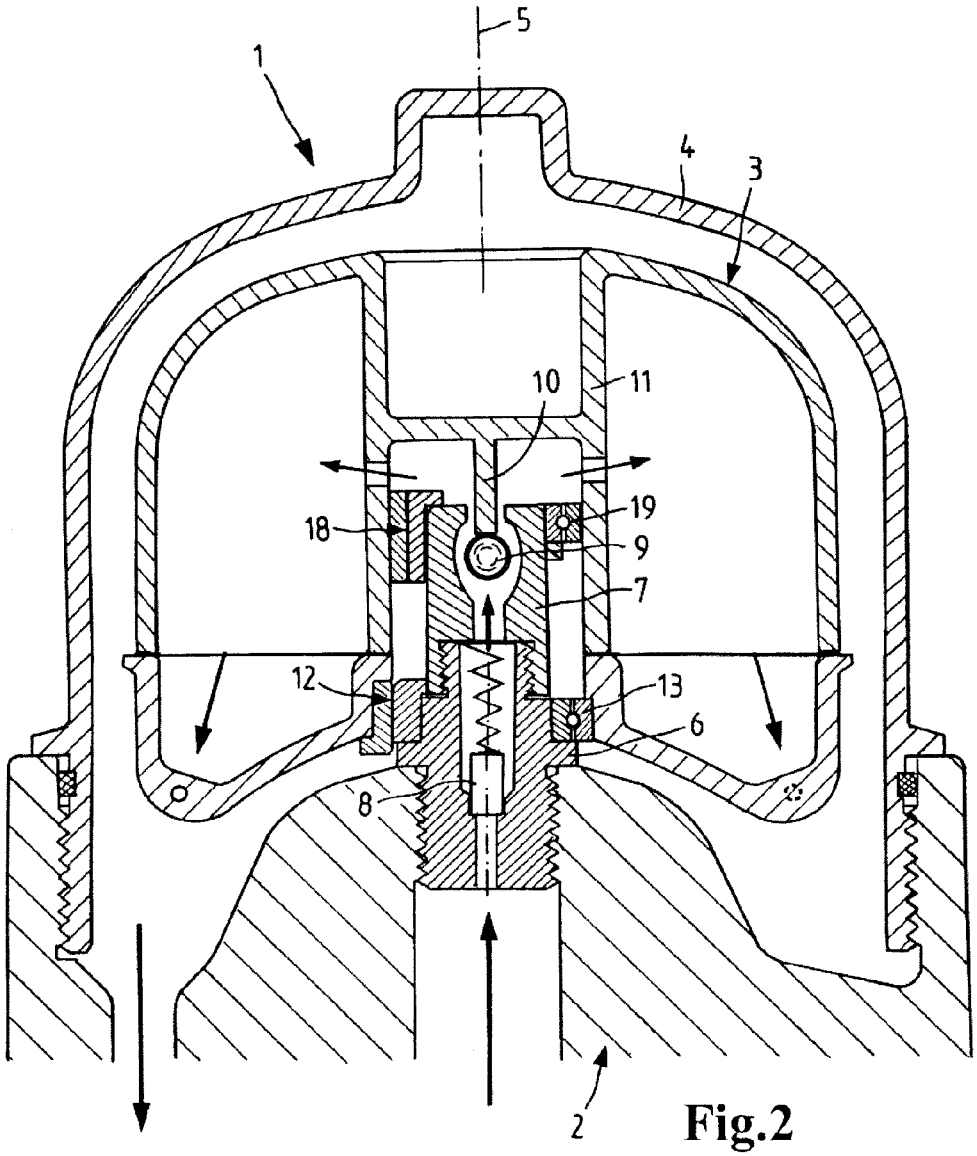
FIG. 2 shows an embodiment corresponding to FIG. 1, but having a second bearing point in the region of the second valve.
Figure 3:
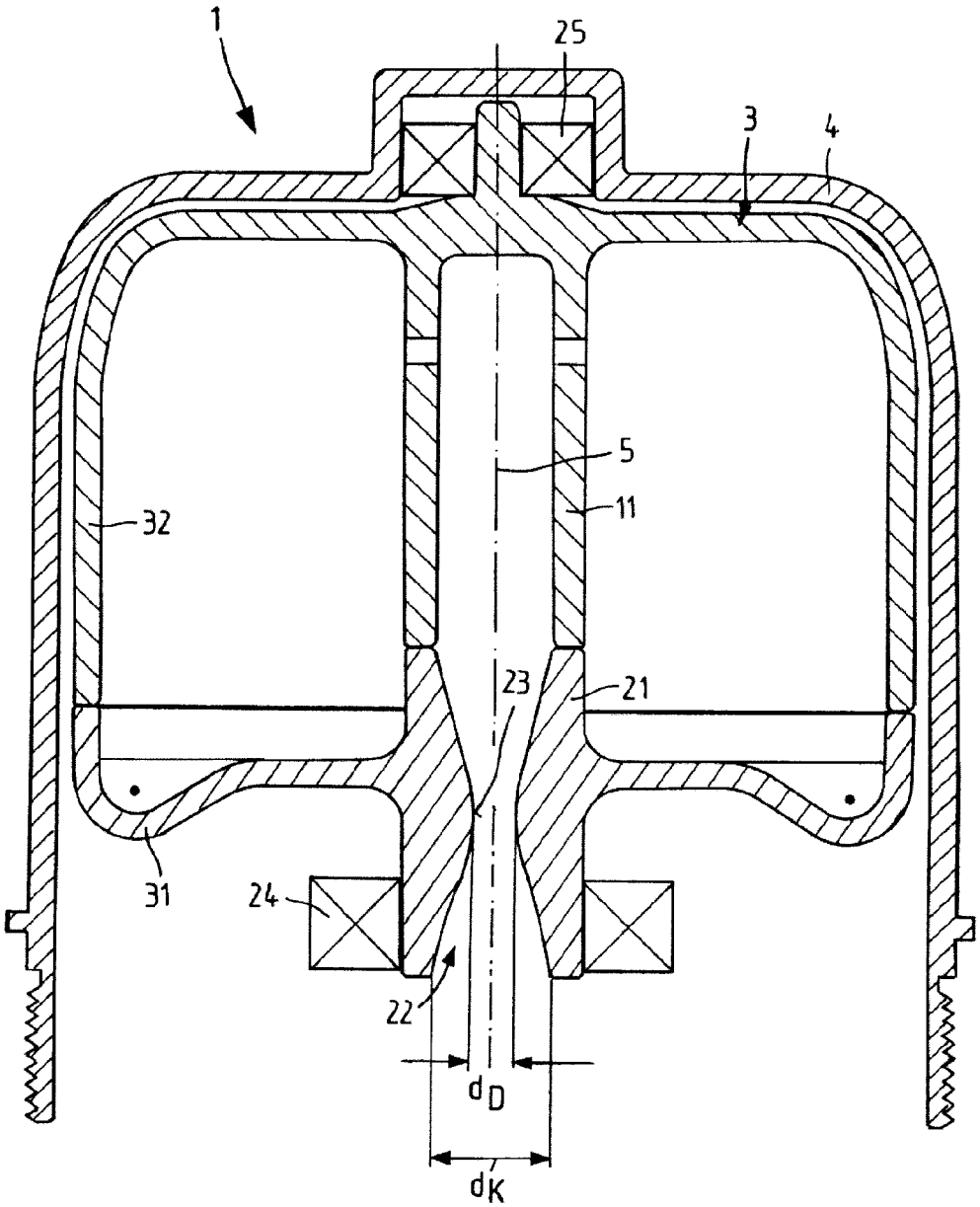
FIG. 3 shows a section through an oil centrifuge with integral centrifuge rotor in a further embodiment without valves, showing the throttle point.

Oil centrifuges 1 with centrifuge rotor 3 for an internal combustion engine, with which the throttle point described in more detail in FIG. 3 can be used, are shown by way of example in FIG. 1 and FIG. 2. However, the throttle point can be incorporated in the flow path to the centrifuge rotor 3 regardless of the number and design of valve devices likewise located in the flow path.

An oil centrifuge 1 for an internal combustion engine is shown in FIG. 1. Preferably, the oil centrifuge 1 is incorporated in an oil circuit with an oil filter. The oil centrifuge 1 can be part of an oil module 2, which comprises the oil filter and the oil centrifuge 1 and, for example, can be designed as a die cast part, in particular made of aluminum. The oil filter has a filter element, in particular a round filter element, through which the oil to be cleaned flows. The oil centrifuge 1 with the centrifuge rotor 3 is positioned downstream of the oil filter in a bypass channel to a main flow channel for the pre-cleaned oil from the oil filter and is enclosed by a bowl or cover-like housing component 4 which is connected, for example, screwed, to the oil module 2 or to a housing bottom. The centrifuge rotor 3 is rotatably mounted opposite the oil module 2 or the housing bottom and the housing component 4 and can rotate about its longitudinal axis 5.

In the oil feed path from the oil module 2 to the centrifuge rotor 3, a pressure valve 6 and a safety valve 7 connected downstream of the pressure valve 6 are provided and designed as a contiguous valve device. The pressure valve 6 and the safety valve 7 are formed as separate components which, however, are contiguous and are connected to one another. Alternatively, the two valves 6, 7 can also be formed in one piece (monolithic) with a common housing. The pressure valve 6 is designed as a piston valve. The spring-loaded piston 8 forming the valve member of the pressure valve 6 is biased in the closed position and is forced in the direction of the open position by the oil on the filtered side of the oil module 2. The piston 8 of the pressure valve 6 opens as soon as the pressure reaches a pressure threshold, for example, 2 bar. Thereupon, the flow path through the upstream pressure valve 6 is enabled.

The downstream safety valve 7 is placed directly on the housing of the pressure valve 6 and connected thereto, for example, screwed thereto. The safety valve 7 is designed as a ball valve; correspondingly, the valve body of the safety valve 7 is formed by a ball 9 which is accommodated in an adjustable manner by the housing of the safety valve 7.

An actuating pin 10, which is formed in one piece (monolithic) with a feed tube 11, which is a one-piece (monolithic) component of the centrifuge rotor 3 and extends centrally on the inside of the centrifuge rotor 3, projects into the safety valve 7. The actuating pin 10 of the centrifuge rotor 3 projects into the discharge path of the safety valve 7 and holds the ball 9 of the safety valve at a distance from its sealing seat so that the flow path in the safety valve 7 is kept free. If, on the other hand, the actuating pin 10 is missing, for example, when the centrifuge rotor 3 is not fitted or is incorrectly fitted, then the ball 9 is displaced by the pressure of the introduced oil into its sealing position and thereby closes the flow path.

The housing of the pressure valve 6 is screwed into the oil module 2. The flow path through the valves 6 and 7 is coaxial with the longitudinal axis 5 of the oil centrifuge 1 and the centrifuge rotor 3. The safety valve 7 projects axially into the feed tube 11 which is formed in one piece (monolithic) with the centrifuge rotor 3 and rotates together therewith; the feed tube 11 is part of the flow path of the oil to the centrifuge rotor 3. The flow path has a throttle point with reduced throttle cross section relative the flow path cross section at other locations, wherein the throttle point is not shown here for better clarity of the illustration. In this regard, the throttle point can be arranged at any point in the flow path to the centrifuge rotor 3, but before outlet openings in the feed tube 11 for introducing the oil into the rotor chambers of the centrifuge rotor 3. For example, the throttle point can be arranged in the housing of the pressure valve 6 or of the safety valve 7. However, the throttle point can also be incorporated downstream of the valves 6 and 7 in the feed tube 11, or upstream of the valves 6 and 7 in the inlet section of the oil centrifuge 1. The diameter or flow cross section of the flow path is increased compared with the throttle point at least upstream of the throttle point. An advantageous form of the throttle point is shown in FIG. 3.

The centrifuge rotor 3 is rotatably mounted by means of two axially spaced bearing points. A first bearing point is located on the outside of the housing of the pressure valve 6 and, as shown in the left-hand diagram half of FIG. 1, is designed in an embodiment as a plain bearing pair with two plain bearing bushes, of which the inner plain bearing bush is located on the wall of the housing of the pressure valve 6 and the outer plain bearing bush on the inside of the feed tube 11 of the centrifuge rotor 3. The plain bearing bushes can be made of different material, for example of a steel-sintered bronze material pairing. Alternatively, as shown in the right-hand diagram half of FIG. 1, the bearing point consists of a ball bearing between the housing of the pressure valve 6 and the inside wall of the feed tube 11 of the centrifuge rotor 3. The plain bearing is designated by reference number 12 and the ball bearing by reference number 13. Also, as an alternative to an embodiment with two plain bearing bushes, only one plain bearing bush can be provided, while the valve housing acts as the sliding partner.

A second bearing point is located on the end face of the centrifuge rotor on the inside of the encompassing housing component 4, axially spaced from the first bearing point between the pressure valve 6 and the centrifuge rotor 3. This second bearing point is designed as a plain bearing 14 and has a plain bearing bush 15, which is set into the end face of the feed tube 11 on the centrifuge rotor 3, and a bearing bolt 16 which is retained by means of a rubber damper 17 on the inside of the housing component 4 and projects into the plain bearing bush 15. The bearing bolt 16 is designed as a steel bolt, for example; the plain bearing bush 15 can be made of sintered bronze.

The flow path through the oil centrifuge 1 is shown by arrows. Filtration is initially carried out in the oil filter; from the filtered side of the oil filter, the oil is fed through the valve device with the pressure valve 6 and the safety valve 7 axially into the feed tube of the centrifuge rotor 3. If both valves 6, 7 are open, the oil passes, as shown by the arrows, via outlet openings in the wall of the feed tube 11 radially into the rotor chambers of the centrifuge rotor 3 where separation of particles takes place. The oil then flows axially downwards and can be channeled out via discharge openings. As a result of the oil pressure and with an appropriate design of the discharge openings, the centrifuge rotor 3 rotates about its longitudinal axis 5.

In the exemplary embodiment according to FIG. 2, the oil centrifuge 1 has basically the same construction as in FIG. 1. Different, however, is the bearing of the centrifuge rotor 3 which is designed as an overhung bearing. A first bearing point between the pressure valve 6 and the end face of the feed tube 11 of the centrifuge rotor 3 is formed similar to FIG. 1 and can be designed either as a plain bearing 12 with two plain bearing bushes or as a ball bearing 13.

A second bearing point is located with comparatively small axial spacing on the safety valve 7 and, like the first bearing point, is formed either as a plain bearing 18 with two plain bearing bushes which, if appropriate, can be made of different materials such as steel and sintered bronze, or as a ball bearing 19. The bearing action occurs on the housing of the safety valve 7 and on the inside wall of the feed tube 11, which is formed in one piece (monolithic) with the centrifuge rotor 3.

An exemplary embodiment of a throttle point 23 in the feed tube 11 of the centrifuge rotor 3 is shown in FIG. 3. The oil is fed to the centrifuge rotor 3 via the feed tube 11 which has a tube section 21 which is formed in one piece (monolithic) with a bottom rotor component 31 of the rotor casing. The feed tube 11 defines the flow path for the oil. The rotor component 31 is located at the bottom of the centrifuge rotor 3 and is formed separately from a rotor top part 32 of the rotor casing. Advantageously however, the bottom rotor component 31 is formed in a fixed rotational relationship with the rotor top part 32 and rotates together therewith about the longitudinal axis 5. As an example, rotor top part 32 and bottom rotor component 31 are welded to one another. Alternatively however, the rotor casing of the centrifuge rotor 3 can also be formed in one piece (monolithic). The tube section 21, which is formed in one piece (monolithic) with the bottom rotor component 31, forms the first part of the feed tube 11 for feeding the oil into the centrifuge rotor 3.

Adjacent to the inflow region 22 which faces away from the centrifuge rotor 3, the tube section 21 is provided with a throttle point 23, which has a reduced throttle cross section compared with the other flow path cross sections. The diameter of the throttle point 23 is designated by $d_D$, the diameter of the tube section 21 upstream and downstream of the throttle point 23 is $d_K$, wherein the throttle point diameter $d_D$ is not more than 40% to 90% of the maximum diameter $d_K$ of the tube section 21. By way of example, the throttle point diameter is between approx. 50% and approx. 60% of the maximum diameter $d_K$. The diameter $d_K$ of the tube section 21 is the same upstream and downstream of the throttle point 23. The throttle point 23 is formed in the manner of a Laval nozzle, for example, and damps pressure peaks, as a result of which the load on the centrifuge rotor 3 is reduced. The throttle point 23 is located axially approximately centrally in the tube section 21 that is flange-connected at the end face to the section of the feed tube 11 which is formed in one piece (monolithic) with the rotor top part 32. In an alternative embodiment, which is not shown, the diameter of the feed tube 11 before and after the throttle point 23 is different, wherein the diameter is increased compared with the throttle point diameter at least upstream of the throttle point 23.

The centrifuge rotor 3 is rotatably mounted on two bearing points 24 and 25. The first bearing point is located on the tube section 21 of the bottom rotor component 31. The second bearing point 25 lies on the axial opposite side in the upper region of the centrifuge rotor 3; the centrifuge rotor 3 is rotatably mounted on the housing component 4 by means of the second bearing point 25.

While specific embodiments of the invention have been shown and described in detail to illustrate the inventive principles, it will be understood that the invention may be embodied otherwise without departing from such principles.

What is claimed is:

1. A centrifuge rotor configured for mounting on bearings to rotate about an axis of rotation within an interior of an oil centrifuge, the centrifuge rotor comprising:

a rotor casing having at least one rotor casing part forming the rotor casing, the rotor casing including:

a circumferential radial outer wall;

a feed tube formed on and monolithically with the rotor casing, the feed tube arranged on the axis of rotation, the feed tube arranged in an interior of the rotor casing and spaced radially inwardly away from the circumferential radial outer wall of the rotor casing;

a flow path adapted to supply oil to the centrifuge, wherein the feed tube forms a portion of a flow path supplying oil to the centrifuge rotor;

a throttle point formed as a Laval nozzle arranged in the feed tube of the rotor casing, the throttle point having:

an inlet end having an upstream flow cross section;

an opposing outlet end having a downstream flow cross section;

a bottleneck section arranged between the inlet end and the outlet end, the bottleneck section having a flow cross-section that is smaller than both the upstream flow cross section and the downstream flow cross section;

wherein a flow cross section of the flow path tapers gradually with no sudden steps in cross section from the Inlet end to the bottleneck;

wherein the flow cross section of the flow path enlarges gradually with no sudden steps in cross section from the bottleneck to the outlet end.

2. An oil centrifuge comprising:

a centrifuge rotor integrated into an interior of the oil centrifuge and mounted on bearings to rotating on an axis of rotation within an interior of the oil centrifuge, the centrifuge rotor including:

a rotor casing having at least one rotor casing part forming the rotor casing, the rotor casing including:

a circumferential radial outer wall;

a feed tube formed on and monolithically with the rotor casing and fixed to rotate with the rotor casing, the feed tube arranged on the axis of rotation, the feed tube arranged in an interior of the rotor casing and spaced radially inwardly away from the circumferential radial outer wall of the rotor casing;

a flow path adapted to supply oil to the centrifuge, wherein the feed tube is connected to and forms a section of the flow path;

a throttle point formed as a Laval nozzle arranged in the feed tube of the rotor casing and rotating together with the rotor casing, the throttle point having:

an inlet end having an upstream flow cross section;

an opposing outlet end having a downstream flow cross section;

a bottleneck section arranged between the inlet end and the outlet end, the bottleneck section having a flow cross-section that is smaller than both the upstream flow cross section and the downstream flow cross section;

wherein a flow cross section of the flow path tapers gradually with no sudden steps in cross section from the Inlet end to the bottleneck;

wherein the flow cross section of the flow path enlarges gradually with no sudden steps in cross section from the bottleneck to the outlet end.

3. The oil centrifuge as claimed in claim 2, wherein the flow path has a downstream flow path cross section downstream of the throttle point and the downstream flow path cross section is increased relative to the bottleneck flow cross-section.

4. The oil centrifuge as claimed in claim 3, wherein the upstream and downstream flow cross sections are identical.

5. The oil centrifuge as claimed in claim 2, wherein the throttle point is in an inflow region of the feed tube.

6. The oil centrifuge as claimed in claim 2, wherein a diameter of the throttle point is maximally 90% of a largest diameter of the flow path.

7. The oil centrifuge as claimed in claim 6, wherein the diameter of the throttle point is maximally 70% of the largest diameter of the flow path.

8. The oil centrifuge as claimed in claim 7, wherein the diameter of the throttle point is maximally 50% of the largest diameter of the flow path.

9. An oil centrifuge comprising:

a centrifuge rotor integrated into an interior of the oil centrifuge and mounted on bearings to rotating on an axis of rotation within an interior of the oil centrifuge, the centrifuge rotor including:

a rotor casing having at least one rotor casing part forming the rotor casing, the rotor casing including:

a circumferential radial outer wall;

a feed tube formed on and monolithically with the rotor casing and rotating with the rotor casing, the feed tube arranged on the axis of rotation, the feed tube arranged in an interior of the rotor casing and spaced radially inwardly away from the circumferential radial outer wall of the rotor casing;

a flow path adapted to supply oil to the centrifuge, wherein the feed tube is connected to and forms a portion of the flow path;

a throttle point having a reduced throttle cross section that is reduced relative to an upstream flow path cross section of the flow path upstream of the throttle point, wherein the throttle point is formed in the feed tube;

a safety valve arranged in the flow path and projecting into and interior of the feed tube of the rotor casing, the safety valve having:

a movable valve closure body arranged within the safety valve, the movable valve closure body displaced by pressure of the flow of oil to the oil centrifuge into a closed state in the safety valve, closing off the flow path of oil;

an actuating pin formed integrally with the feed tube of the centrifuge rotor and projecting into the safety valve, the actuating pin engaging against and holding the movable valve closure body in an open state allowing for flow into the centrifuge rotor;

a pressure valve arranged in the flow path in the oil centrifuge, wherein the safety valve is arranged downstream of the pressure valve, wherein the pressure valve is held in a closed state by a spring until oil pressure in the flow path reaches or exceeds a preset pressure threshold, transitioning the pressure valve to an open state.

* * * * *